US008538052B2

(12) United States Patent
Elmedyb et al.

(10) Patent No.: US 8,538,052 B2
(45) Date of Patent: Sep. 17, 2013

(54) GENERATION OF PROBE NOISE IN A FEEDBACK CANCELLATION SYSTEM

(75) Inventors: Thomas Bo Elmedyb, Smørum (DK); Johan Hellgren, Linköping (SE)

(73) Assignee: Oticon A/S, Smorum (DK)

( * ) Notice: Subject to any disclaimer, the term of this patent is extended or adjusted under 35 U.S.C. 154(b) by 924 days.

(21) Appl. No.: 12/668,329

(22) PCT Filed: Jun. 26, 2008

(86) PCT No.: PCT/EP2008/058156
§ 371 (c)(1),
(2), (4) Date: Jan. 8, 2010

(87) PCT Pub. No.: WO2009/007245

PCT Pub. Date: Jan. 15, 2009

(65) Prior Publication Data

US 2010/0183164 A1 Jul. 22, 2010

(30) Foreign Application Priority Data

Jul. 10, 2007 (EP) ..... 07112147

(51) Int. Cl.
*H04R 25/00* (2006.01)

(52) U.S. Cl.
USPC ..... 381/318; 381/312; 381/317

(58) Field of Classification Search
USPC ..... 381/312, 317, 318, 320, 321, 71.11, 381/83, 93
See application file for complete search history.

(56) References Cited

U.S. PATENT DOCUMENTS 5,016,280 A 5/1991 Engebretson et al.
5,680,467 A 10/1997 Hansen (Continued)

FOREIGN PATENT DOCUMENTS

EP 0 581 261 A1 2/1994
EP 1 835 708 A2 9/2007

(Continued)

OTHER PUBLICATIONS

Forsell et al., "Closed-Loop Identification Revisited-Updated Version", Department of Electrical Engineering, pp. 1-55, Apr. 1, 1998.
ISO/MPEG Commitee, "Coding of Moving Pictures and Associated Audio for Digital Storage Media at up to About 1,5 MBIT/S", 1st Edition, Part 3, pp. 1-158, Aug. 1, 1993.

(Continued)

*Primary Examiner* — Huyen D Le
(74) *Attorney, Agent, or Firm* — Birch, Stewart, Kolasch & Birch, LLP

(57) ABSTRACT

The invention regards a scheme for generating a probe noise signal to be used in an anti feedback system of an audio system. The audio system comprises e.g. a microphone for capturing an audio signal, an audio signal processor for adaptation of the audio signal and a receiver for generation of an audible signal. According to an embodiment of the invention, a noise signal is injected into the audio signal path between the microphone and the receiver and used for estimating acoustical feedback, the noise signal being generated by the following steps:

- converting a digitized audio signal to the frequency domain, in order to obtain a series of magnitude and phase values,
- changing the phase values such that the phase of the resulting signal becomes less correlated, preferably substantially un-correlated, to the original signal,
- converting the magnitude and phase back to a time domain signal using the changed phase values.

The invention may e.g. be used in a hearing aid, a headset or a pair of headphones.

27 Claims, 5 Drawing Sheets

(56) References Cited

U.S. PATENT DOCUMENTS

| | | | | |
|---|---|---|---|---|
| 6,097,823 | A | 8/2000 | Kuo | |
| 7,463,745 | B2 * | 12/2008 | Miller, III | 381/318 |
| 2005/0047620 | A1 | 3/2005 | Fretz | |
| 2005/0226447 | A1 | 10/2005 | Miller, III | |

FOREIGN PATENT DOCUMENTS

| | | | |
|---|---|---|---|
| WO | WO-01/06812 | A1 | 1/2001 |
| WO | WO-2004/105430 | A1 | 12/2004 |
| WO | WO-2005/079109 | A1 | 8/2005 |

OTHER PUBLICATIONS

Moore, "An Introduction to the Psychology of Hearing", 5th Edition, Chapter 3, pp. 65-126, 2004.

Painter at al., "Perceptual Coding of Digital Audio", proceeding of the IEEE, vol. 88, No. 4, pp. 451-513, Apr. 2000.

Proakis et al., "Digital Signal Processing", Prentice Hall, New Jersey, 3rd. Edition, pp. 623-630, 1996.

* cited by examiner

GENERATION OF PROBE NOISE IN A FEEDBACK CANCELLATION SYSTEM

AREA OF THE INVENTION

The invention relates to an anti-feedback system, especially to a probe noise signal in an anti-feedback system in an audio system, e.g. a hearing aid, in particular in a sound processor.

BACKGROUND OF THE INVENTION

Hearing aid feedback cancellation systems (for reducing or cancelling acoustic feedback from an 'external' feedback path from output to input transducer of the hearing aid) according to the prior art may comprise an adaptive filter, which is controlled by a prediction error algorithm, e.g. an LMS (Least Means Squared) algorithm, in order to predict and cancel the part of the microphone signal that is caused by feedback from the receiver of the hearing aid. FIG. 1*a* illustrates an example of this. The adaptive filter (in FIG. 1 comprising a 'Filter' part end a prediction error 'Algorithm' part) is aimed at providing a good estimate of the 'external' feedback path from the DA to the AD. The prediction error algorithm uses a reference signal together with the microphone signal to find the setting of the adaptive filter that minimizes the prediction error when the reference signal is applied to the adaptive filter. The forward path (alternatively termed 'signal path') of the hearing aid comprises signal processing ('HA-DSP' in FIG. 1) to adjust the signal to the impaired hearing of the user.

In feedback cancellation systems, it may be desirable to add a probe signal to the output signal. This probe signal can be used as the reference signal to the algorithm, as shown in FIG. 1*b* (output of block PS), or it may be mixed with the ordinary output of the hearing aid to form the reference signal.

Prior art feedback cancellation systems comprising a probe or noise generator used in the feedback path are e.g. disclosed in U.S. Pat. No. 5,680,467, U.S. Pat. No. 5,016,280 and EP 1203510. WO 2004/105430 describes a method and apparatus for suppressing oscillation in a signal identified as or suspected of containing an oscillation due to feedback. The method involves converting the signal into frequency bands in the frequency domain, applying, for a selected period of time, a randomly changing phase to the signal in at least one of said frequency bands, and reconverting the converted signal into an output wave form signal. The method is "breaking the loop" by randomizing the phase.

Ideally, the probe signal should be un-correlated with the acoustic input signal, be inaudible and have as much energy as possible. White noise signals have been proposed in some prior art references, but the level of the noise then has to be low in order to remain inaudible. Lower levels of the reference signal will usually cause less accurate estimation of the feedback path, or slower adaptation of the system.

SUMMARY OF THE INVENTION

It is an object of the invention to propose a scheme for generating an improved probe signal. It is a further object that the probe signal is as close to the ideal as possible. It is a further object that the probe signal uses a minimum of computational power. It is a further object that the scheme is adaptable to the characteristics of an audio input signal. It is a further object to provide a hearing aid comprising a noise generator and a feedback cancellation system comprising an adaptive filter wherein the input reference signals to the adaptive filter are less correlated than without the noise generator. The probe/noise signal will be added to the captured signal, and thereby it will not break the loop, but provide an identification signal for the adaptive algorithm.

In the following, the terms probe signal, noise (signal) and probe noise (signal) are used interchangeably and not intended to imply differences in properties of the corresponding signals.

According to an aspect of the invention, a (digitized) noise signal is injected into the audio signal path, e.g. of a hearing aid, (comprising a microphone input signal digitized with sampling frequency $f_s$ and possibly further digitally processed) between the microphone and the receiver, and this noise signal is generated by the following steps:

- converting the audio signal to the frequency domain, in order to obtain a series of magnitude and phase values,
- changing the phase values such that the phase of the resulting signal becomes less correlated (e.g. as indicated by a decreasing correlation coefficient), preferably substantially un-correlated to the original signal,
- converting the magnitude and phase back to a time domain signal using the changed phase values.

In an embodiment, the noise signal is used in the estimation of acoustic feedback from the receiver to the microphone.

In an embodiment, the phase values are adapted to provide that the correlation coefficient is at least 10% decreased, such as at least 20% decreased, such as at least 30% decreased, such as at least 50% decreased, such as at least 70% decreased, such as at least 80% decreased, such as at least 90% decreased, such as at least 95% decreased.

According to a further embodiment of the invention a method of generating a probe noise signal for use in feedback cancellation in an acoustic system, such as a hearing aid is provided. The method comprises:

- capturing a digitized audio signal by storing consecutive values u(n) of the signal;
- converting the captured audio signal to the frequency domain U(k) by a transformation, whereby a series of magnitude values Mag[U(k)] and phase values Phase[U(k)], are obtained; and
- generating a series of artificial phase values Phase'[U(k)], which are substantially un-correlated to phase values Phase[U(k)] of the captured signal, and converting the series of corresponding magnitude values Mag[U(k)] and artificial phase values Phase'[U(k)] by an inverse transformation to a signal in the time domain thereby generating a digitized probe noise signal r(n) which is substantially un-correlated to the original audio signal u(n).

When using the method according to the invention it becomes possible to generate a probe noise signal, which is very close to an ideal noise signal. It will be difficult to hear the probe noise signal when added to the captured audio signal and played to the human ear. The probe noise signal will have the same magnitude spectrum as the ideal signal and it is therefore easily masked by signal components of the audio signal.

The term 'substantially un-correlated' is in the present context taken to mean that the two signals in question, here the original and artificial phase signals, are substantially independent. In an embodiment, 'substantially un-correlated' is taken to mean having a covariance that is substantially zero. In an embodiment, the correlation (or correlation coefficient) between the two signals over a specific frequency range (such as e.g. from 1 kHz to $f_s/2$, where $f_s$ is the sampling frequency) is in the range from −50% to +50%, such as from −30% to +30%, such as from −10% to +10%, such as from −5% to +5%, such from −2% to +2%, such as from −0.5% to +0.5%, such as from −0.05% to +0.05%, such as essentially zero.

In an embodiment, the sampling frequency f, is in the range from 4 kHz to 40 kHz, such as e.g. in the range from 8 kHz to 24 kHz, such as around 12 kHz or 16 kHz or 20 kHz.

In an embodiment, the method further comprises d. storing consecutive values of the digitized probe noise signal r(n).

In an embodiment of the invention, the artificial phase values Phase'[U(k)] are substantially un-correlated to phase values Phase[U(k)] of the captured signal. According to an embodiment of the invention, the artificial phase values of the generated probe noise signal in c. are generated by a random generator. This assures that the noise signal is un-correlated with the original signal at all times and irrespective of the properties of the original signal. According to another embodiment of the invention the artificial phase values of the generated probe noise signal in c. are set to a fixed value. This is an easy way to assure that the noise signal is not correlated with the original signal, if the input phase is random (or not fixed). Alternatively, the probe noise signal could be frequency shifted compared to the captured signal. This could be useful at least for a short period, to avoid build up noise from the probe noise system. Alternatively, the artificial phase values of the generated probe noise signal are set to a number of different constant values each corresponding to a different frequency range (e.g. one (e.g. relatively lower) value at lower frequencies and another (e.g. relatively higher) value at higher frequencies).

In an embodiment, the method further comprises a windowing-process a.1. prior to b. to reduce border effects when the transform is applied to a u(n) vector. Examples of windowing functions with appropriate frequency response characteristics are e.g. discussed in J. G. Proakis, D. G. Manolakis, *Digital Signal Processing*, Prentice Hall, New Jersey, 3rd edition, 1996, ISBN 0-13-373762-4, chapter 8.2.2 *Design of Linear-Phase FIR filters Using Windows*, pp. 623-630.

In an embodiment, the method further comprises b.1. scaling the magnitude values of the probe noise signal according to the magnitude values Mag[U(k)] of the captured audio signal in b such that the probe noise signal remains substantially inaudible when added to the captured audio signal and played to the human ear.

In an embodiment, masking effects are taken into account in order to determine the maximum allowable magnitude values of the probe noise signal such that the probe noise signal remains substantially inaudible when added to the captured audio signal and played to the human ear. The term masking is defined as the process (or amount [dB]) by which the threshold of audibility for one sound is raised by the presence of another (masking) sound. Masking effects can in general be observed if the 'masking' and 'masked' sounds occur simultaneously or at different instances in time. In an embodiment, simultaneous masking is used. Masking effects are well known and have been used previously in e.g. audio storing and reproduction systems (cf. e.g. MPEG-1, Audio Layer 3 (MP3), cf. e.g. *ISO/MPEG Committee, Coding of moving pictures and associated audio for digital storage media at up to about* 1.5 *Mbit/s—part* 3*: Audio,* 1993, ISO/IEC 11172-3, or T. Painter, A. Spanias, *Perceptual coding of digital audio*, Proceedings of the IEEE, vol. 88, 2000, pp. 451-513). The benefit of the use of masking effects in connection with the method is that it allows a louder noise signal to be used without being audible to the user. Thus a more efficient feed-back cancellation system is provided. In the present context, the masking signal is the digitized input signal from the input transducer (appropriately processed by a signal processing unit according to a user's needs) and the signal to be masked by the masking signal is the probe noise signal. Masking effects are generally discussed in B. C. J. Moore, 'An Introduction to the Psychology of Hearing', Elsevier Academic Press, 2004, Chapter 3.

In an embodiment, the method further comprises b.2. scaling the magnitude values of the probe noise signal to remain below the hearing threshold of an ear of a person to whom the signal is presented.

In an embodiment, the conversion to the frequency domain (b.), the generation of artificial phase values, and the conversion of the magnitude values and artificial phase values back to a time domain signal (c.) is performed in overlapping batches, whereby the probe noise signal is generated by adding the generated noise signal from overlapping batches after subjecting each batch to a windowing function c.1. The conversion to and from the frequency domain is preferably performed by a Fast Fourier Transform (FFT) and Inverse FFT process, respectively. Here a number N_fft of signal amplitude values are processed in a batch process. In order to allow a smooth transition from batch to batch, overlapping of the batch processing and adding under a windowing function is suggested. It should be noted that the FFT process is one of several processes available for going from time to frequency domain. Presently the FFT process is the best known and best documented digital process and therefore it is preferred and referred to in the following. Other ways of performing the frequency transformation could be used, however, including e.g. DHT (discrete Hartley transform), FHT (fast Hartley transform), cosine, etc.

In an embodiment, the method further comprises e. deriving signal parameters from the captured sound signal for f. controlling the conversion of the captured signal from the time to frequency domain. The signal parameters in question are primarily the parameters, which anyway will be determined in a hearing aid for controlling noise damping, directionality, program choice and frequency shaping. Of actual parameters speech to noise ratio, feedback detector, wind noise detector and frequency shape of the signal could be mentioned. The way in which the FFT conversion is controlled is preferably by way of determining the number of digital signal values used in each conversion. Here a narrow bandwidth of the captured microphone signal should promote the use of a long FFT and a broadband microphone signal should promote a shorter FFT being used. In other words, a signal which is concentrated in frequency should promote a long FFT and a signal which is concentrated in time should promote a short FFT. The terms 'short' and 'long' in connection with the FFT refers to number of samples in the FFT (cf. parameter N_fft later).

In an embodiment, the method further comprises h. determining a modulation level parameter (e.g. a fast changing level) from the captured signal and using it for generating the probe noise signal. In an embodiment, the method further comprises g. determining a size parameter for controlling the size of the series of magnitude values generated in the frequency domain and using it for generating the probe noise signal. In an embodiment, the number of samples in each transform in b. is adapted to the rate of change of the digitized audio signal, e.g. by adapting the size parameter in g., preferably to decrease the number of samples N_fft per FFT frame, the higher the rate of change of the audio signal (or vice versa).

In an embodiment, the method provides that the digitized probe noise signal r(n) is added to the captured audio signal u(n), or to an optionally delayed version u'(n) of the audio signal, the delay being adapted to the delay incurred by the process of generating the probe noise signal.

Preferably, the overall level of the probe noise signal is controlled by the properties of the captured signal (cf. h.→b.1., cf. FIG. 4). Here it is preferred that the level of the noise signal is lowered when a rapidly changing microphone signal is captured. The generated probe noise is computed from a number of earlier samples of the captured signal. The number is given by the FFT size parameter N_fft. This results in probe noise being added to the output signal with some delay compared to the captured signal. If the level is reduced dramatically after it was captured, the generated noise may be audible as the present level of the microphone signal is lower compared to the captured microphone signal used to compute the probe noise. With a steady input, on the other hand, the features of the captured signal will be similar between captured frames. Then there is no need to reduce the gain. Also the overall noise level and FFT size parameter can be used in the modification of magnitude for masking and the Individual Hearing Threshold (cf. h.→b.2., cf. FIG. 4). With a steady input signal, it can be useful to have a high value of the FFT size to get high frequency resolution and to be able to shape the spectrum of the noise after the signal. With rapid changes in the level of the signal, however, it is more desirable to rapidly change the characteristics of the noise than to have a high frequency resolution. By reducing the FFT size, the probe noise can be changed more rapidly at the expense of a lower frequency resolution.

In a further aspect, a method for cancelling feedback in an acoustic system is provided. The acoustic system comprises a microphone, a signal path, a speaker, an (electrical) feedback path comprising a feedback estimation unit, e.g. comprising an adaptive feedback cancellation filter, for compensating at least partly a possible feedback signal between the speaker and the microphone, where e.g. an adaptive algorithm for generating filter coefficients for the adaptive feedback cancellation filter is used, and where a probe noise signal for use as an input to the feedback estimation unit, such as to the adaptive algorithm, is generated by:

capturing a digitized audio signal in the time domain from the microphone, converting the captured audio signal to the frequency domain, whereby a series of real magnitude and real phase values are obtained, generating a series of artificial phase values which are substantially un-correlated with phase values of the captured signal, allocating corresponding real magnitude values and artificial phase values of the series of values and converting these to a time domain signal to obtain a probe noise signal.

In an embodiment, the feedback estimation unit comprises an adaptive filter comprising a variable filter part and an update algorithm part. Alternatively, the feedback estimation unit can be implemented in other appropriate ways.

In an embodiment, the signal path comprises a digital signal processor (e.g. for providing a frequency dependent hearing profile). In an embodiment, the probe noise signal is used as a reference signal to the adaptive algorithm (e.g. an LMS- or an RLS-algorithm). In an embodiment, the output signal (for being fed to a DA-converter to provide an analogue input to the speaker, cf. signal u(n)+r(n) in FIG. 1*d*) is used as an input signal to an adaptive filter (e.g. a FIR- or an BR-filter) . In an embodiment, a delay is inserted in the forward path to compensate for the possible delay incurred by the generation of probe noise (e.g. delaying the captured audio signal u(n) (after the branching off of u(n) to the probe signal generator) to align characteristics of the audio signal u(n) in time with the corresponding characteristics of the probe noise signal r(n)).

In a further aspect, a probe noise signal generator for use in feedback cancellation in an acoustic system is provided. The probe noise signal generator comprises An input buffer for capturing and storing consecutive values u(n) of the digitized audio signal;

A converting unit for converting the captured audio signal to the frequency domain U(k) by a transformation, whereby a series of magnitude values Mag[U(k)] and phase values Phase[U(k)], are obtained; and A generating unit for generating a series of artificial phase values Phase'[U(k)], which are substantially un-correlated to phase values Phase[U(k)] of the captured signal, and an inverse converting unit for converting the series of corresponding magnitude values Mag[U(k)] and artificial phase values Phase'[U(k)] by an inverse transformation to a signal in the time domain thereby generating a digitized probe noise signal r(n).

In an embodiment, the probe noise signal generator further comprises d. An output buffer for storing consecutive values of the digitized probe noise signal r(n).

In an embodiment, the generating unit c. comprises a random generator for generating artificial phase values of the generated noise signal. In an embodiment, the generating unit c. comprises a fixed value generator for generating artificial phase values of the generated noise signal.

In an embodiment, the probe noise signal generator comprises an adding unit for adding the digitized probe noise signal r(n) and the captured, digitized audio signal u(n). In an embodiment, the probe noise signal generator comprises a delay unit in the forward path to compensate for the possible delay incurred by the probe noise generator.

The probe noise generator has the same advantages as the method of generating a probe noise signal described above, in the detailed description and in the claims. The features of the method—in an equivalent structural form—are intended to be combined with the probe noise signal generator, where appropriate.

In a further aspect, use of a probe noise signal generator as described above, in the detailed description and in the claims in a head worn acoustic system, such as a hearing aid or a headset or a pair of headphones is provided.

In a further aspect, a hearing aid comprising a probe noise signal generator as described above, in the detailed description and in the claims or a probe noise signal generator obtainable by a method as described above, in the detailed description and in the claims is provided.

In an embodiment, the hearing aid comprises a microphone, a forward or signal path, a speaker, an (electrical) feedback path comprising an adaptive feedback estimation or cancellation unit (e.g. an adaptive filter, e.g. a FIR or IIR filter) for compensating at least partly a possible (external) feedback signal between the speaker and the microphone. In an embodiment, the probe noise signal is used by the adaptive feedback estimation or cancellation unit (e.g. together with a signal from the forward path) to estimate the acoustic feedback. The output from the feedback estimation or cancellation unit is used to compensate or cancel acoustic feedback. In an embodiment, the forward path comprises a delay unit to fully or partially compensate for a possible delay incurred by the probe noise generator. In an embodiment, the feedback path comprises and adaptive feedback cancellation filter with an adaptive algorithm for generating filter coefficients for the adaptive feedback cancellation filter. In an embodiment, the signal path comprises a signal processing unit (e.g. for shaping the frequency dependence of the input signal according to a particular profile). In an embodiment, the signal path further comprises an AD-converter for digitizing the analogue input from the microphone. In an embodiment, the signal path further comprises a DA-converter for creating an analogue output signal as input to the speaker. In an embodiment, the output signal u(n) from the signal processing unit is used as an input to the probe noise generator. In an embodiment, the probe noise signal r(n) from the probe noise generator is fed to the adaptive algorithm and used as a reference signal. In another embodiment, a sum of the output signal u(n) from the signal processing unit and the probe noise signal r(n) (i.e. signal u(n)+r(n)) is used as an input signal to the adaptive filter (e.g. FIR-filter). In an embodiment, the probe signal generator is implemented in the signal processing unit as a part of the same integrated circuit.

The basic idea of a probe noise generator according to the invention is to generate a probe noise signal r(n) that has the same or a similar spectrum as the output signal u(n) but is less correlated to u(n), so that the input reference signals (cf. e.g. signals e(n) and r(n) in FIG. 1*d*) to the adaptive filter are less correlated than without the noise generator (e.g. 10% less or 30% less or 50% less or 90% less, such as substantially uncorrelated). In an embodiment, a two stage process or similar is used to estimate the feedback path. In an embodiment, a projection method is used to estimate the feedback path (cf. e.g. U. Forssell, L. Ljung, *Closed-loop Identification Revisited—Updated Version*, Linköping University, Sweden, LiTH-ISY-R-2021, 1 Apr. 1998, pp. 19, ff.).

In an embodiment, the hearing aid comprises an input transducer for converting an input sound to an electric input signal and an output transducer for converting a processed electric output signal to an output sound, a forward path being defined between the input transducer and the output transducer and comprising a signal processing unit defining an input side and an output side of the forward path, a feedback loop from the output side to the input side for estimating the effect of acoustic feedback from the output transducer to the input transducer and comprising an adaptive FBC filter comprising a variable filter part for providing a specific transfer function and an update algorithm part for updating the transfer function of the variable filter part, the update algorithm part receiving first and second update algorithm input signals from the input and output side of the forward path, respectively, wherein the input signal to the update algorithm part from the output side of the forward path includes (such as is equal to) the digitized probe noise signal from the noise generator. In an embodiment, the input signal to the variable filter part from the output side includes (such as is equal to) the sum of the digitized probe noise signal from the noise generator and the output from the signal processing unit. In an embodiment, the input to the update algorithm part from the output side includes the digitized probe noise signal from the noise generator and the output from the signal processing unit (such as is equal to the sum of said signals).

In an embodiment, the variable filter part of the FBC filter receives an input from the output side of the forward path and delivers an output, which is subtracted from the electric input signal to provide a feedback corrected input signal, which is used as an input to the signal processing unit and to the algorithm part of the adaptive filter.

In an embodiment, the input to the variable filter part of the FBC filter from the output side includes (such as is equal to) the digitized probe noise signal from the noise generator.

In an embodiment, the output from the signal processing unit is an input to the probe noise signal generator. In an embodiment, the electric input signal is adapted to be digital. In an embodiment, the processed electric output signal is adapted to be digital.

In an embodiment, the hearing aid is adapted to provide that the digitized probe noise signal r(n) from the noise generator is added to the captured, digitized audio signal u(n). In an embodiment, the sum signal r(n)+u(n) is used as an input to the variable filter part of the adaptive filter. In an embodiment, the hearing aid is adapted to provide that the digitized audio signal u(n) is delayed corresponding to the delay in the probe noise signal generator to align r(n) and u(n) in time when they are added. Referring to FIG. 1*e*, a delay unit for delaying the captured audio signal u(n) from the signal processing unit 4 is inserted after the branching off of u(n) to the probe signal generator 9 and before the summation unit 12 to align characteristics of the audio signal u(n) in time with the corresponding characteristics of the probe noise signal r(n)).

It is intended that the various features mentioned above, in the detailed description and in the claims can be combined in the different embodiments of the invention where appropriate.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present. Furthermore, "connected" or "coupled" as used herein may include wirelessly connected or coupled. As used herein, the term "and/or" includes any and all combinations of one or more of the associated listed items.

BRIEF DESCRIPTION OF THE DRAWINGS

The figures are schematic and simplified for clarity, and they just show details which are essential to the understanding of the invention, while other details are left out. Throughout, the same reference numerals or letters are used for identical or corresponding parts.

DESCRIPTION OF A PREFERRED EMBODIMENT

In the following, embodiments of the invention exemplified in relation to hearing aids are discussed. The examples may likewise be implemented in relation to other audio systems.

Figure 1A:
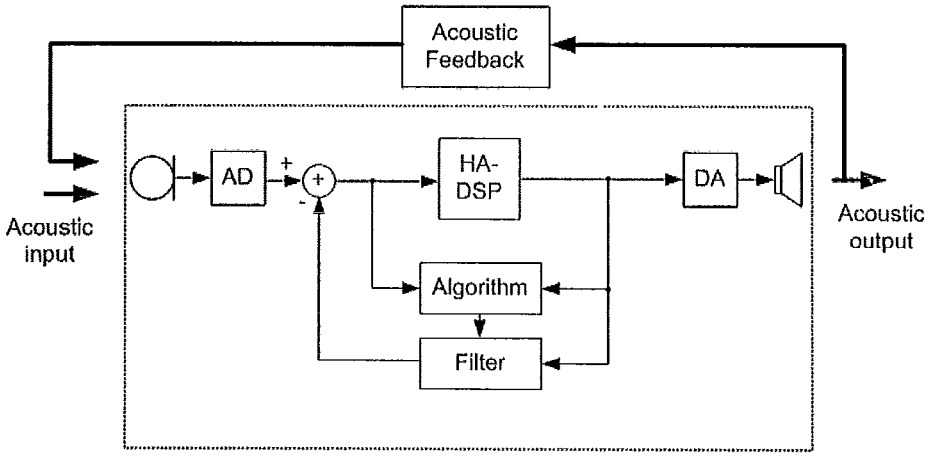
FIG. 1 shows schematic representations of embodiments of a hearing aid comprising a signal path and a feedback cancellation path, the latter comprising an adaptive filter (FIG. 1*a*), an embodiment further comprising a probe noise generator (FIG. 1*b*), a general embodiment of the invention comprising a probe noise generator and a feedback estimation unit (FIG. 1*c*), an embodiment comprising a preferred coupling of a probe noise generator (FIG. 1*d*) and a further embodiment comprising another preferred coupling of a probe noise generator (FIG. 1*e*).
Figure 1B:
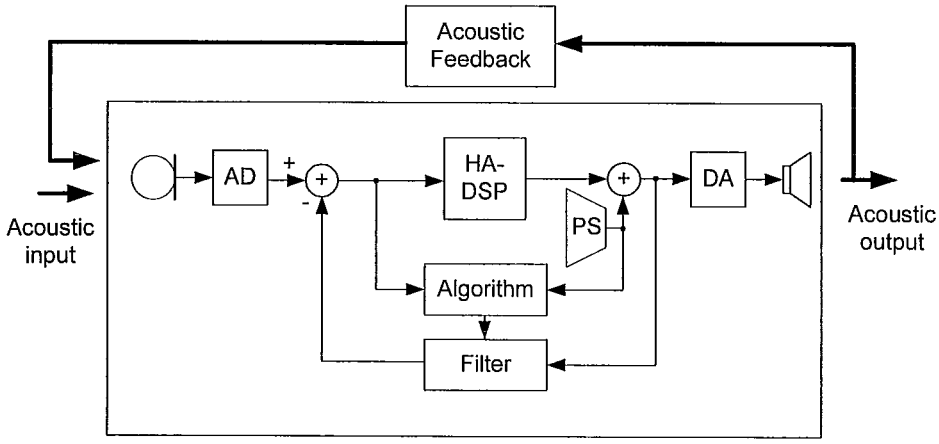
Figure 1C:
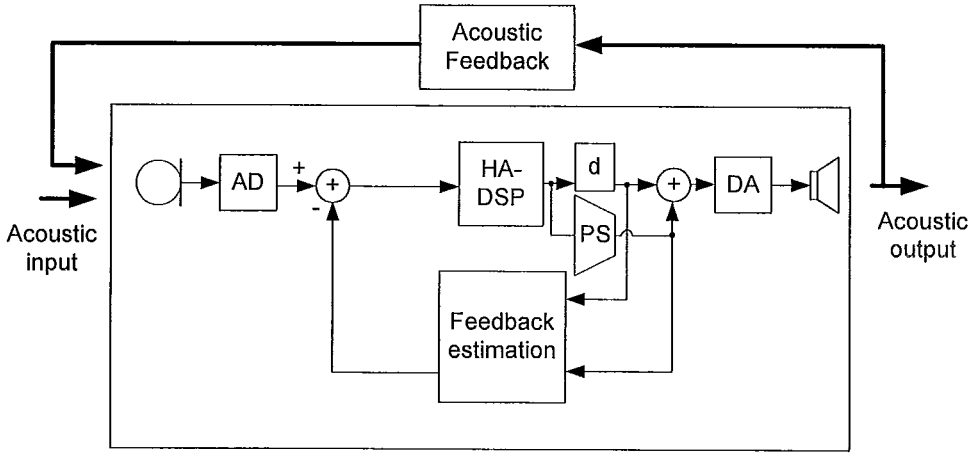

A hearing aid according to an embodiment of the invention is shown in FIG. 1*c*, wherein the forward path comprises a microphone a signal processing unit (HA-DSP in FIG. 1*c*) and receiver. A probe noise generator (PS in FIG. 1*c*) takes an input from the forward path (here from the output of the signal processing unit) and generates a probe noise signal as described below (cf. e.g. FIGS. 2-4), which is fed to a feedback estimation unit (Feedback estimation in FIG. 1*c*) as well as being added to the (optionally delayed, cf. block d in FIG. 1*c*) output from the signal processing unit, the sum of the two signals being converted to an acoustic signal by the receiver. Analogue to Digital (AD) and Digital to Analogue (DA) converters are indicated in the forward path after the microphone and before the receiver, respectively. The converters may be located in the path at any convenient specific location depending on the practical implementation. In addition to the probe noise signal, the (optionally delayed) output from the signal processing unit is fed to the feedback estimation unit, whose output representing an estimate of the acoustic feedback path is subtracted from the microphone input signal and the resulting sum-signal is fed to the signal processing unit. The optional delay unit (d in FIG. 1*c*) is preferably adapted to provide a delay corresponding to the delay of the probe noise generator (PS).

Figure 1D:
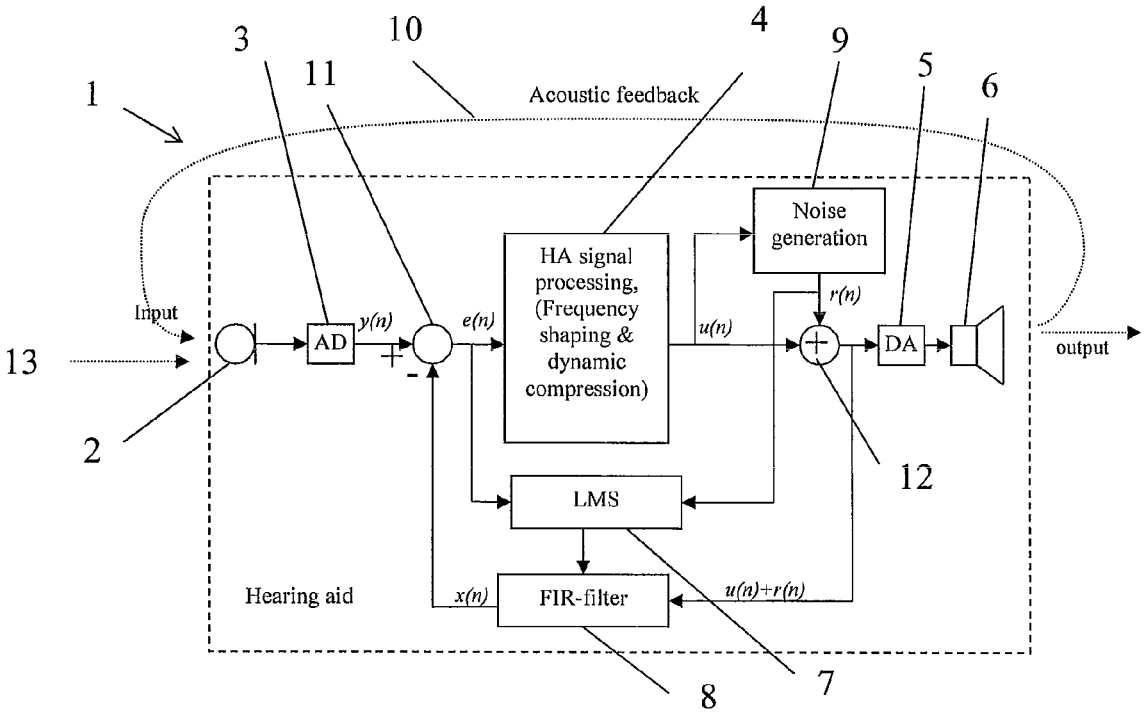

The hearing aid 1 shown in FIG. 1*d* comprises an input transducer 2, usually a microphone coupled to an AD converter 3 (AD) with a sampling frequency $f_s$, which produces the digitized electrical signal y(n), a hearing aid digital signal processing unit 4 (HA signal processing) for frequency shaping and e.g. dynamic compression of the input signal producing the signal u(n), a DA converter 5 (DA) coupled to an output transducer 6, usually a speaker. The speaker 6 is typically termed a 'receiver' in hearing aids. Means for cancelling acoustic feedback 10, here comprising an adaptive filter 7, 8 comprising an adaptive algorithm 7 (LMS), such as an LMS algorithm (or e.g. an RLS (Recursive Least Squares) algorithm), which provides correction factors to filter coefficients for a filter part 8 (FIR-filter), e.g. a FIR (Finite Impulse Response) filter (or an IIR (Infinite Impulse Response) filter). The LMS algorithm is adapted to give an impulse response as close as possible to the external feedback path from the DA to the AD. The FIR-filter 8 constitutes an internal (electrical) feedback path. If the two feedback paths, the FIR-filter 8 and the (external) acoustic feedback 10 have identical impulse responses, the acoustic feedback 10 will be cancelled, because the internal feedback signal x(n) from the adaptive filter part 8 at Σ-block 11 is subtracted from the signal y(n) from the AD converter 3, which contains the external feedback 10. The residual result e(n) of the subtraction from subtraction point 11 (Σ-block 11) would then represent the desired acoustic input signal 13. The LMS algorithm 7 tries to adjust the coefficients such that the FIR-filter 8 can predict as large a part as possible of the signal y(n). The LMS algorithm 7 uses the energy of the residual after cancellation, $e(n)^2$, as the measure of the success and tries to minimize it. The probe signal r(n) from the probe noise generator 9 (Noise generation) is used as the reference signal in the LMS algorithm 7. This means that the LMS algorithm 7 is adjusted so that the prediction error is minimized as if the probe signal alone was applied to the FIR-filter. This is known as the indirect identification method. Alternatively, the output signal u(n) may be used as reference signal input (without the probe signal) to the adaptive filter (this arrangement being termed the direct identification method). In the embodiment shown in FIG. 1*d*, the signal u(n) from the signal processing unit 4 is used as an input to the probe noise generator 9. Further, the output signal r(n) from the probe noise generator 9 is added to the output signal u(n) from the signal processing unit 4 in Σ-block 12, providing the output signal u(n)+r(n), which is fed to the DA converter 5 (for DA-conversion and acoustical output via output transducer 6) and to the filter part 8 of the adaptive filter of the feedback path. Preferably, a delay unit for delaying the captured audio signal u(n) from the signal processing unit 4 is inserted into the embodiment of FIG. 1*d*, after the branching off of u(n) to the probe signal generator 9 and before the summation unit 12 to align characteristics of the audio signal u(n) in time with the corresponding characteristics of the probe noise signal r(n)).

Figure 1E:
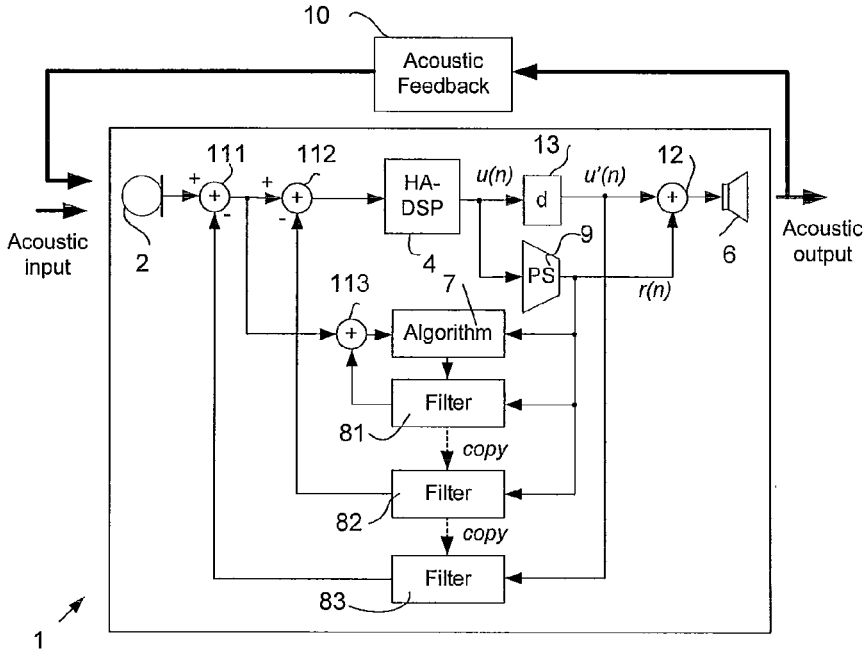

FIG. 1*e* shows another embodiment of a hearing aid 1 according to the invention. Compared to the embodiment shown in FIG. 1*e*, the present embodiment includes a delay unit 13 (d in FIG. 1*e*) implementing a delay of the audio signal u(n) equal to the delay of the probe signal generator 9 (PS in FIG. 1*e*), providing a delayed audio signal u'(n). The delayed audio signal u'(n) is added to the probe signal r(n) in Σ-block 12 and converted to an acoustic output through receiver 6. The probe signal r(n) is used as an input to an adaptive filter (7, 81) comprising an algorithm part 7 and a variable filter part 81. The electric feedback loop comprises further variable filter parts 81, 82 whose filter characteristics are determined by the algorithm part 7 and copied to the variable filter parts 81, 82 at instances in time in dependence of the fulfilment of one or more predefined criteria (e.g. relating to estimated signal quality; i.e. don't copy during low signal quality). Variable filter part 83 is adapted to estimate the (delayed) audio signal u'(n) taking u'(n) as its input, its output being subtracted from the (digitized) electric input signal from microphone 2 in Σ-block 111. The other input to the algorithm part 7 is a sum (performed in Σ-block 113) of the output from Σ-block 111 (input signal corrected with estimate of u'(n)) and the output of variable filter part 81. Variable filter part 82 is adapted to estimate the probe noise signal r(n) taking r(n) as its input, its output being subtracted from the output of Σ-block 111 in Σ-block 112. The output of Σ-block 112 is used as an input the digital signal processing unit 4 (HA-DSP), whose output, the audio signal u(n), is fed to the delay unit 13 and to the probe noise generator 9 (PS in FIG. 1*e*). The benefit of this configuration is that the filter coefficients are only copied to filter 82 and 83 when filter 81 has obtained a reliable estimate. We are thereby "hiding" poor estimates, for the end user, since the poorly estimated filter are only used in the update part of the algorithm and not in the cancellation part.

Figure 2:
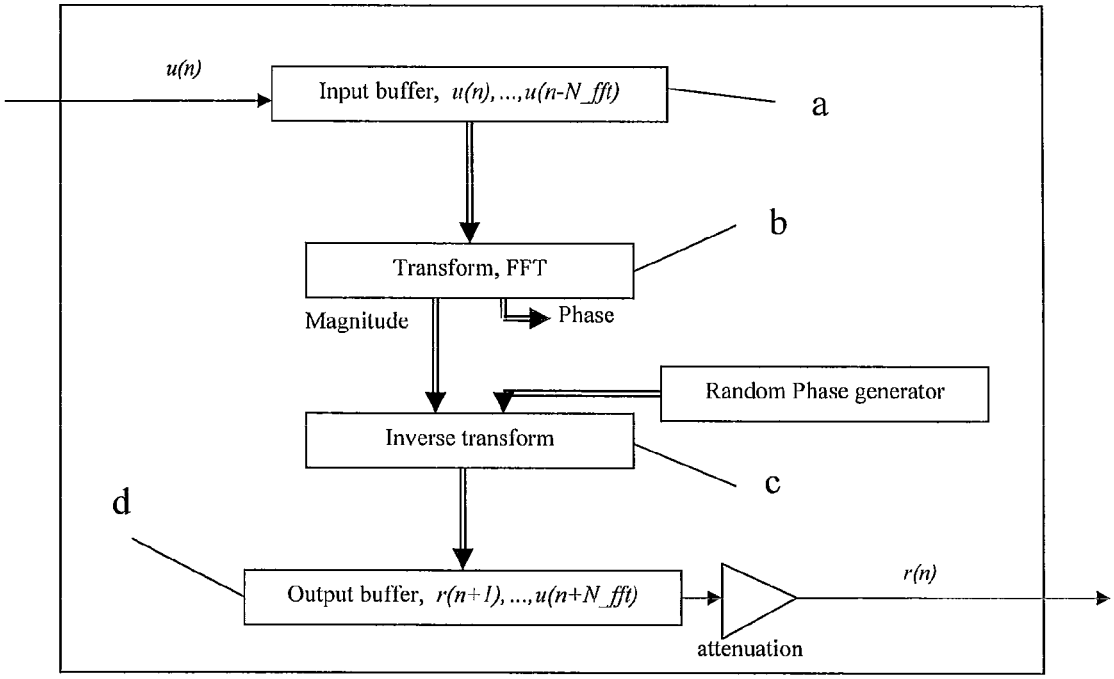
FIG. 2 shows the basic steps of generating probe noise according to an embodiment of the invention (or alternatively the functional blocks of a corresponding probe noise generator).

According to an embodiment of the invention, the probe noise generator (9 in FIG. 1*d*, denoted 'Noise generation' or denoted 'PS' in FIGS. 1*b*, 1*c*, 1*e*) is adapted to generate a signal that has the same spectrum as the output u(n) but is un-correlated to u(n). As indicated in FIG. 2, this can be done by processing the (digitized) output signal u(n) in a number of steps (or functional blocks), a, b, c, d as outlined in the following.

Step a.:

Store consecutive u(n) values in an input puffer, u(n), u(n-N_fft).

Step b.:

Perform a transformation (e.g. an FFT transformation) on the u(n) values in the buffer, whereby magnitude and phase values are generated.

With a FFT, the transform is computed as:

$$U(k) = \sum_{j=0}^{N_fft-1} u(n - \mathrm{N_fft} + 1 + j)\omega_{N_fft}^{jk}$$

Where k is the bin number (containing data corresponding to a specific frequency component), $\omega_{N_fft}=e^{(-2\pi i)/N_fft}$, and N_fft is the number of points in the transform. The formula may thus alternatively be written as follows:

$$U(k) = \sum_{j=0}^{N_fft-1} u(n - \mathrm{N_fft} + 1 + j)e^{-i2\pi kj/N_fft}$$

The magnitude and phase is then computed as $$Mag(k)=|U(k)|$$

$$\mathrm{phase}(k)=\angle U(k)$$

such that $$U(k)=Mag(k)e^{i*phase(k)}$$

Due to the signal u(n) being real valued, the magnitude will be symmetric around N_fft/2 and the phase will be asymmetric around N_fft/2

$$Mag(k)=Mag(N_fft-k), k=1,2, \ldots, N_fft-1$$

$$\mathrm{phase}(k)=-\mathrm{phase}(N_fft-k), k=1,2, \ldots N_fft-1$$

The original signal can be recreated by the inverse transform:

$$u(j + n - \mathrm{N_fft} + 1) = \frac{1}{\mathrm{N_fft}} \sum_{k=0}^{N_fft-1} U(k)\omega_{N_fft}^{-jk}$$

Step c.:

The magnitude values are inputs to an inverse FFT transformation, and here also phase values are needed. If the original phase values from the FFT transformation are used, the signal would ideally by an exact copy of the input signal u(n) and maximum correlation would be obtained. This is not wanted, and in order to get a signal, which is completely un-correlated to the u(n) signal, the inverse FFT is based on phase values which have no correlation to the phase values from the FFT. According to an embodiment of the invention, such phase values are obtainable by using a phase that is independent of the original phase. This can be obtained either by setting a constant phase, assuming that the original phase varies in a stochastic manner or by generating random phase values. Both would assure that the resulting noise signal would be un-correlated to the original signal u(n). The used phase should be asymmetric around N_fft/2 in order to give a real valued signal in the time domain.

Step d.:

The generated noise signal values are stored in an output buffer r(n+1), . . . , r(n+N_fft) wherefrom they are optionally fed through an attenuation step and added to the output signal u(n) before entering the DA converter.

Figure 3:
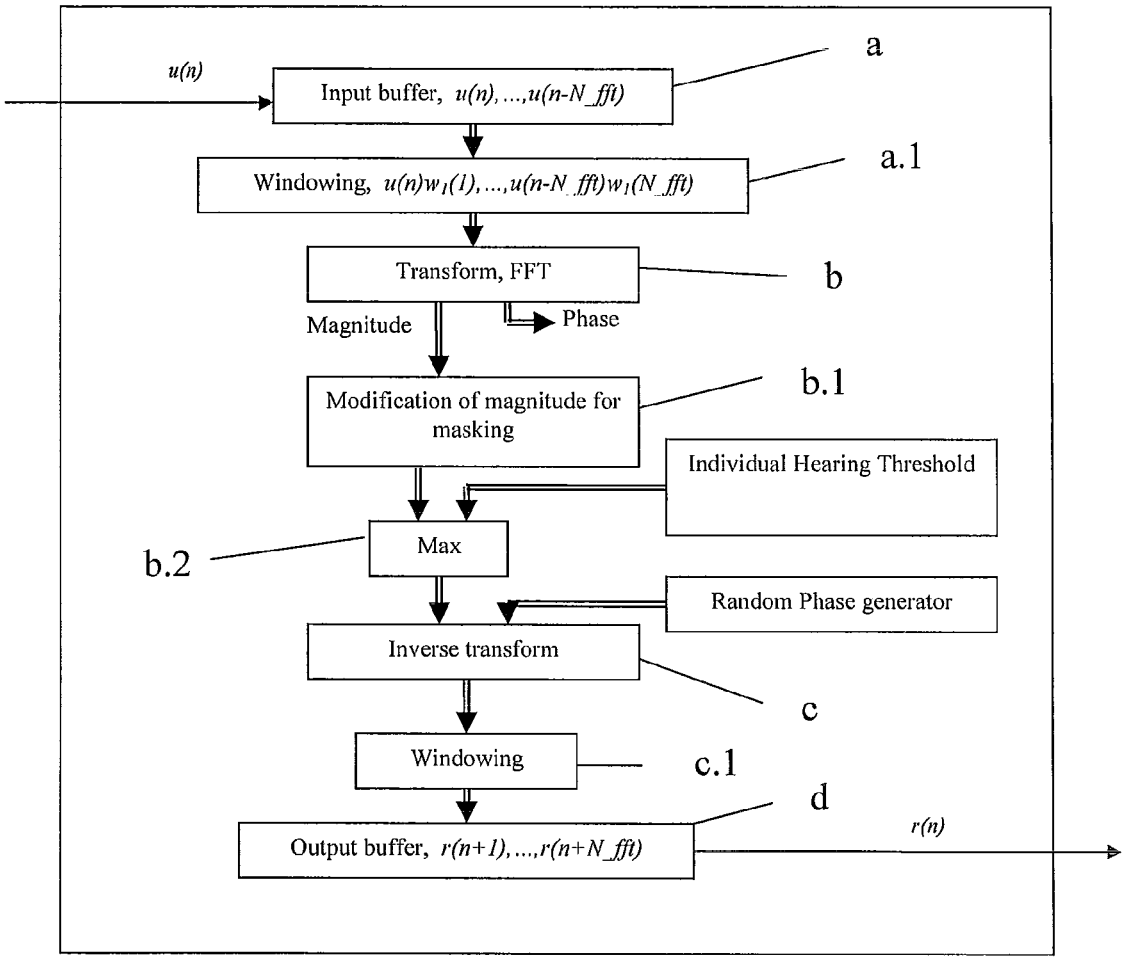
FIG. 3 shows an embodiment, which takes the hearing threshold into account.

In FIG. 3, another embodiment of the invention is displayed. In addition to the steps a., b., c., d. of the embodiment of FIG. 2, this embodiment comprises further steps denoted a.1., b.1., b.2., c.1. referring to their functional relation to the steps of FIG. 2. The further steps may be all or individually applied to the steps of the embodiment of FIG. 2. The further steps (or functional blocks of a probe noise generator) are described in the following.

Prior to the transform in step b., a windowing-process step a.1. is performed to reduce border effects when the transform is applied to a vector. After the transformation in step b., the magnitude is modified (e.g. based on psycho acoustical masking effects) in a modification step b.1. so that the magnitude after this modification represents the maximum magnitude of a signal that can be presented together with the original signal, while being inaudible. In an embodiment, the magnitude is modified to give the highest possible noise level and still be inaudible to the user. The noise level could be determined by a perceptual model. Upward spread of masking causes signals with higher frequency than the original signal to be inaudible, if presented at levels up to a limit. This limit varies with the frequency of both the original and the added signal. Downward spread of masking is the corresponding effect for tones with lower frequency than the original signal. Downward spread of masking is less pronounced than upward spread of masking. In a subsequent optional maximizing step b.2., the magnitude is increased to the individual hearing threshold, if it was lower than this. The magnitude can be increased to this level while still being inaudible as the hearing threshold is the lower limit for audible signals. The magnitudes can e.g. be adapted to an individual hearing profile or be based on a 'typical' profile.

The resulting magnitudes are then combined with a new phase vector to get a signal that is un-correlated to the original signal u(n) when inversely transformed in step c. to the time domain. A windowing step (c.1.) can finally be applied to the time domain signal to avoid border effects.

The probe noise generator can preferably generate the noise in batches with size given by the size of the transform (FFT). Here, the term 'size' is taken to mean the number of samples in the FFT (N_fft). These batches will usually be mutually un-correlated as they are generated with random phase. The transition from one batch to the next may then have a discontinuity. Thus it is useful to use overlapping batches and a windowing function to get a smooth transition between batches (cf. step c.1.).

The transforms are preferably performed more frequently than once every N_fft sample and samples of the signal u(n) can preferably be used in more than one batch. The is processing will then produce a new batch of signals before the last batch has been shifted out. The signals of the two batches are then added to get the probe signal. A window function can preferably be applied to the batches before the addition to reduce border effects.

Figure 4:
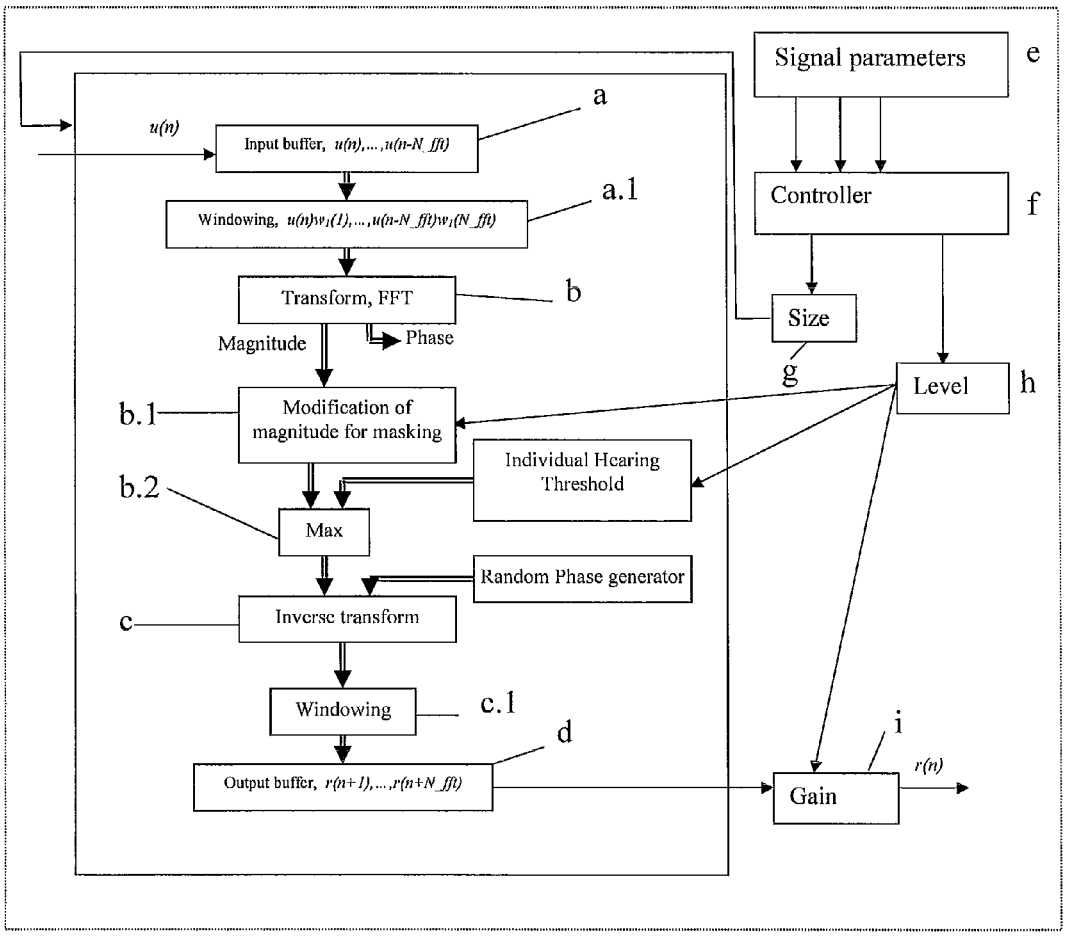
FIG. 4 shows a further embodiment, whereby the feedback cancellation processing is guided by parameters of the captured signal.

In FIG. 4, another embodiment of the invention is shown. In addition to the steps a., b., c., d. of the embodiments of FIGS. 2 and 3, this embodiment comprises further steps denoted e., f., g., h., i. The further steps may be all or individually applied to the steps of the embodiments of FIG. 2 or FIG. 3. The further steps (or functional blocks of a probe noise generator) are described in the following.

In this embodiment of the invention, the FFT conversion and generation of the probe noise signal is guided by signal parameters, which are generated in other parts of the instrument. Examples of such signal parameters could e.g. be transient detection, fast level estimation, howl detection, music detection parameters. The signal parameters are captured in bloc e. and routed to a controller block f. In controller block f., size parameters and level parameters are determined (from the captured signal parameters) and separated and routed to size block g. and level block h., respectively.

From size block g., controlling parameters are routed to all the blocks used to generate the noise (cf. arrow from size block g. to the solid frame representing blocks a.-d., as e.g. implemented by the embodiment of FIG. 3).

As an example, the FFT size controlled by block g. could switch between 64 and 512 samples. A size of 512 samples is preferably used when a high frequency resolution is desirable (and a relatively slower calculation is acceptable) and a size of 64 samples is used when changing characteristics are required (i.e. a relatively faster calculation is preferred). The FFT size controls the number of samples N_fft buffered in input buffer block a., the length of the window used in windowing block a.1., the size of the FFT in transform block b., the number of magnitudes to modify in modification block b.1., the number of values in modification block b.1. to be used in the Max function block b.2. after block b.1., the number of phases that the random phase generator (giving inputs to the inverse transform block c.) should give, the size of the inverse transform in block c., the size of the window in windowing block c.1., and the size of the buffer in output buffer block d.

From level block h., level parameters are routed to modification block b.1., max block b.2. and gain block i., respectively. Gain block i. is a gain setting block, which determines the gain of the outputted noise signal. The gain block i. corresponds to the block represented by a triangular symbol (denoted 'attenuation') in FIG. 2.

The block h. provides the option of rapidly reducing the level of the noise if there is a fast reduction of the level of the signal u(n). The level of the noise can then be reduced by adjusting the gain of block i. The level block can also be used to control how the magnitude is modified in block b.1. (e.g. by controlling the masking effect). If the signal is a pure tone, the magnitude of the noise has to be reduced more than if it is a broad band signal.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

REFERENCES

U.S. Pat. No. 5,680,467

U.S. Pat. No. 5,016,280

EP 1203510

WO 2004/105430 (DYNAMIC HEARING PTY) Feb. 12, 2004

J. G. Proakis, D. G. Manolakis, *Digital Signal Processing*, Prentice Hall, New Jersey, 3rd edition, 1996, ISBN 0-13-373762-4

ISO/MPEG Committee, *Coding of moving pictures and associated audio for digital storage media at up to about* 1.5 *Mbit/s—part* 3: *Audio,* 1993, ISO/IEC 11172-3

B. C. J. Moore, An Introduction to the Psychology of Hearing, Elsevier, 5th edition, 2006, ISBN-13: 978-0-12-505628-1

T. Painter, A. Spanias, *Perceptual coding of digital audio*, Proceedings of the IEEE, vol. 88, 2000, pp. 451-513

U. Forssell, L. Ljung, *Closed-loop Identification Revisited—Updated Version*, Linköping University, Sweden, LiTH-ISY-R-2021, 1 Apr. 1998.

The invention claimed is:

1. A method of generating a probe noise signal for use in feedback cancellation in an acoustic system, the method comprising:

capturing a digitized audio signal by storing consecutive values u(n) of the signal;

deriving signal parameters from the captured digitized audio signal for controlling conversion of the captured digitized audio signal from time domain to frequency domain;

determining a size parameter for controlling size of a series of magnitude values to be generated in the frequency domain;

converting the captured digitized audio signal to the frequency domain U(k) by a transformation, whereby the series of magnitude values Mag[U(k)] and phase values Phase[U(k)], are obtained, wherein the number of samples in each transformation is based on a rate of change of the digitized audio signal;

generating a series of artificial phase values Phase'[U(k)], which are substantially un-correlated to phase values Phase[U(k)] of the captured signal; and converting the series of corresponding magnitude values Mag[U(k)] and artificial phase values Phase'[U(k)] by an inverse transformation to a signal in the time domain thereby generating a digitized probe noise signal r(n) which is substantially un-correlated to the original audio signal u(n).

2. A method as claimed in claim 1 further comprising:

storing consecutive values of the digitized probe noise signal r(n).

3. A method as claimed in claim 1, wherein the artificial phase values of the generated probe noise signal are generated by a random generator.

4. A method as claimed in claim 1, wherein the artificial phase values of the generated probe noise signal are set to a fixed value or to a number of fixed values, each corresponding to a different frequency range.

5. A method as claimed in claim 1, further comprising:

a windowing-process to reduce border effects when the transformation is applied to a u(n) vector.

6. A method as claimed in claim 1, further comprising:

scaling the magnitude values of the probe noise signal according to the magnitude values Mag[U(k)] of the captured audio signal such that the probe noise signal remains substantially inaudible when added to the captured audio signal and played to the human ear.

7. A method as claimed in claim 6 whereby masking effects are taken into account in order to determine the maximum allowable magnitude values of the probe noise signal such that the probe noise signal remains substantially inaudible when added to the captured audio signal and played to the human ear.

8. A method as claimed in claim 1, further comprising:

scaling the magnitude values of the probe noise signal to remain below the hearing threshold of an ear of a person to whom the signal is presented.

9. A method as claimed in claim 1, wherein conversion to the frequency domain, the generation of artificial phase values, and the conversion of the magnitude values and artificial phase values back to a time domain signal is performed in overlapping batches, whereby the probe noise signal is generated by adding the generated noise signal from overlapping batches after subjecting each batch to a windowing function.

10. A method as claimed in claim 1, further comprising:

determining a modulation level parameter from the captured signal and using it for generating the probe noise signal.

11. A method as claimed in claim 1 wherein the digitized probe noise signal r(n) is added to the captured audio signal u(n).

12. A method a claimed in claim 1, further comprising:

reducing the size parameter to decrease the number of samples in response to an increase in the rate of change of the digitized audio signal.

13. A method for cancelling feedback in an acoustic system where the acoustic system comprises a microphone, a signal path, a speaker, an adaptive feedback cancellation filter for compensating at least partly a possible feedback signal between the speaker and the microphone, where an adaptive algorithm for generating filter coefficients for the adaptive feedback cancellation filter is used and where a probe noise signal for the adaptive algorithm is generated by:

capturing a digitized audio signal in the time domain from the microphone;

deriving signal parameters from the captured digitized audio signal for controlling conversion of the captured digitized audio signal from time domain to frequency domain;

determining a size parameter for controlling size of a series of magnitude values to be generated in the frequency domain;

transforming the captured digitized audio signal to the frequency domain, whereby a series of magnitude values are obtained, wherein the number of samples in each transformation is based on a rate of change of the digitized audio signal;

generating a series of artificial phase values which are un-correlated with real phase values of the captured signal;

allocating corresponding magnitude values and artificial phase values of the series of values; and converting the allocated magnitude values and artificial phase values to a time domain signal to obtain a probe noise signal.

14. A method according to claim 13 wherein the probe noise signal is added to the captured digitized audio signal and used as an input for the adaptive algorithm.

15. A hearing aid, comprising:

a probe noise signal generator for use in feedback cancellation in an acoustic system, the probe noise signal generator comprising an input buffer for storing consecutive values u(n) of a captured, digitized audio signal, a converting unit for converting the captured, stored audio signal to the frequency domain U(k) by a transformation, whereby a series of magnitude values Mag[U(k)] and phase values Phase[U(k)], are obtained, a generating unit for generating a series of artificial phase values Phase'[U(k)], which are un-correlated to phase values Phase[U(k)] of the captured signal, and an inverse converting unit for converting the series of corresponding magnitude values Mag[U(k)] and artificial phase values Phase'[U(k)] by an inverse transformation to a signal in the time domain thereby generating a digitized probe noise signal r(n);

an input transducer for converting an input sound to an electric input signal;

an output transducer for converting a processed electric output signal to an output sound;

a forward path defined between the input transducer and the output transducer, the forward path including a signal processing unit defining an input side and an output side of the forward path;

a feedback loop from the output side to the input side comprising a feedback estimation unit for estimating the effect of acoustic feedback from the output transducer to the input transducer, wherein an input signal to the feedback estimation unit from the output side of the forward path includes the digitized probe noise signal from the probe noise signal generator.

16. A hearing aid according to claim 15, further comprising:

an output buffer for storing consecutive values of the digitized probe noise signal r(n).

17. A hearing aid according to claim 15, wherein the generating unit comprises a random generator for generating artificial phase values of the generated noise signal.

18. A hearing aid according to claim 15, wherein the generating unit comprises a fixed value generator for generating artificial phase values of the generated noise signal.

19. A hearing aid according to claim 15, further comprising:

an adding unit for adding the digitized probe noise signal r(n) and the captured, digitized audio signal u(n).

20. A hearing aid according to claim 15, wherein the feedback estimation unit comprises an adaptive FBC filter comprising a variable filter part for providing a specific transfer function and an update algorithm part for updating the transfer function of the variable filter part, the update algorithm part receiving first and second update algorithm input signals from the input and output side of the forward path, respectively, wherein the input signal to the update algorithm part from the output side of the forward path includes the digitized probe noise signal from the probe noise signal generator.

21. A hearing aid according to claim 20 wherein the variable filter part receives an input from the output side of the forward path and delivers an output, which is added to the electric input signal to provide a feedback corrected input signal, which is used as an input to the signal processing unit and to the algorithm part of the adaptive filter.

22. A hearing aid according to claim 20 wherein the input to the update algorithm part from the output side of the forward path is equal to the digitized probe noise signal from the probe noise signal generator.

23. A hearing aid according to claim 20 wherein the input to the variable filter part from the output side includes the digitized probe noise signal from the probe noise signal generator and the output from the signal processing unit.

24. A hearing aid according to claim 20 wherein the input to the update algorithm part from the output side includes the digitized probe noise signal from the probe noise signal generator and the output from the signal processing unit.

25. A hearing aid according to claim 15, wherein the output from the signal processing unit is an input to the probe noise signal generator.

26. A hearing aid according to claim 15, wherein the digitized probe noise signal r(n) from the probe noise signal generator is added to the captured, digitized audio signal u(n) and used as an input to the feedback estimation unit.

27. A hearing aid according to claim 26, wherein the digitized audio signal u(n) is delayed before being added to the digitized probe noise signal r(n) to compensate for a possible delay in the probe noise signal generator.

* * * * *